US005474034A

United States Patent [19]

Gounder

[11] Patent Number: 5,474,034

[45] Date of Patent: Dec. 12, 1995

[54] SUPERCRITICAL STEAM PRESSURIZED CIRCULATING FLUIDIZED BED BOILER

[75] Inventor: Ponnusami K. Gounder, San Diego, Calif.

[73] Assignee: Pyropower Corporation, San Diego, Calif.

[21] Appl. No.: 230,888

[22] Filed: Apr. 20, 1994

Related U.S. Application Data

[63] Continuation of Ser. No. 134,171, Oct. 8, 1993.

[51] Int. Cl.[6] ..... B09B 3/00; F22B 1/00

[52] U.S. Cl. ..... 122/4 D; 122/1 R; 165/104.16

[58] Field of Search ..... 122/1 R, 4 D; 60/39, 464; 110/245, 263, 347; 431/7; 165/104.16

[56] References Cited

U.S. PATENT DOCUMENTS

| | | | |
|---|---|---|---|
| 2,989,038 | 6/1961 | Schwarz | 122/406 |
| 3,194,218 | 7/1965 | Schroedter et al. | 122/406 |
| 3,370,573 | 2/1968 | Hanzalek et al. | 122/406 |
| 3,411,300 | 11/1968 | Schuetzeneuebel et al. | 60/104 |
| 3,888,470 | 6/1975 | Szewalski | 60/647 |
| 4,290,389 | 4/1981 | Palchik | 122/406 |
| 4,325,327 | 4/1982 | Kantesaria et al. | 122/4 D |
| 4,655,147 | 4/1987 | Brannstrom et al. | 110/263 |
| 4,730,563 | 3/1988 | Titornblad | 110/216 |
| 4,767,315 | 8/1988 | Brannstrom et al. | 431/7 |
| 4,862,692 | 9/1989 | Fukuda et al. | 60/670 |
| 5,163,384 | 11/1992 | Brannstrom et al. | 122/4 D |
| 5,176,109 | 1/1993 | Engstrom | 122/4 |

FOREIGN PATENT DOCUMENTS

| | | | |
|---|---|---|---|
| 1139421 | 1/1969 | United Kingdom | 22/29 |
| 1200954 | 9/1970 | United Kingdom | 22/35 |

OTHER PUBLICATIONS

"Combined Circulation Boilers", J. I. Argersinger.

"Steam Generator/Turbine Matching At Public Service Indiana Gibson Station", L. W. Leath et al.

"Supercritical Steam Generator Design For Slicing Pressure Operation", Martinez et al. (American Power Conference, Apr. 27, 28 and 29, 1981)

*Primary Examiner*—Henry A. Bennet

*Assistant Examiner*—Siddharth Ohri

*Attorney, Agent, or Firm*—Baker, Maxham, Jester & Meador

[57] ABSTRACT

A circulating fluidized bed boiler comprises a fluidized bed combustion chamber, a recirculating system for recirculating fluidized solids through the combustion chamber, and a plurality of tubes for withstanding supercritical pressure are disposed around the walls of the combustion chamber for circulating cooling fluid between an inlet header at the bottom of the chamber and an outlet chamber at the top of the combustion chamber. A water steam separator directs steam to a superheater and is bypassed during normal operation.

12 Claims, 2 Drawing Sheets

SUPERCRITICAL STEAM PRESSURIZED CIRCULATING FLUIDIZED BED BOILER

This application is a continuation of application Ser. No. 08/134,171, filed Oct. 8, 1993, now abandoned.

BACKGROUND OF THE INVENTION

The present invention relates to power plats and pertains particularly to pressurized circulating fluidized bed (PCFB) boiler power plants for operating at supercritical steam pressures.

There exists in the power generating industry an ever increasing need for more efficient power plants for converting fossil fuels to electrical power. This need continues to increase as the cost and scarcity of clean burning conventional fuels becomes even greater. This requirement for more efficient plants has led to the development of supercritical boiler designs for some large conventional power plants.

Supercritical operation is at pressure above 3208 psi so that steam does not separate from the liquid, i.e. a single phase fluid. Supercritical boiler designs have been used in fossil fuel fired conventional power plants. These large conventional power plants typically have furnace pressure very close to the atmosphere pressure.

The major concern in designing supercritical boilers is to establish and maintain sufficient water mass flow through the combustor wall tubes under all operating conditions. This is complicated by the presence of the flame in the conventional boiler combustors. The presence of flame in the combustor produces a high heat flux to the water walls and hence a higher mass flow is required through the tubes to keep the tube wall temperatures low.

The need for higher efficiency plants is even greater for convening lower grades of sulfur containing fuels, such as coal, that exist in abundance in many regions of the world. These lower grades of fuel create atmospheric pollution when burned in conventional combustors. Many of these fuels contain impurities, such as sulfur which reacts in the combustion process forming compounds such as $SO_2$ that is particularly noxious and pollution. Systems, including scrubbers, have been developed for removing these pollutants from exhaust gasses of power plants. However, these systems are very expensive and frequently not cost effective for most power plants.

Circulating fluidized bed combustors have been developed in recent years for burning sulfur containing fuels to generate steam for powering steam turbines. The circulating fluidized bed combustor has been further improved by pressurization of the combustor. The pressurized circulating fluidized bed combustor operates at pressures substantially above atmospheric pressure with a mixture of granular limestone or other sorbent materials supported on a non-sifting grid. An upward flow of pressurized air passes through the grid lifting and fluidizing the material. This results in a turbulent mixture of the bed particles having the free flowing properties of a liquid and providing an environment for stable combustion. Fuels introduced into the bed will burn effectively, and sulfur dioxide released by the burning is chemically captured by the calcined limestone. The mixture of solids which includes ash and calcined limestone is recirculated through the combustor until the particle size is reduced sufficiently for elution through the cyclones.

As sulfur containing fuel is burned, the sulfur combusts with oxygen to form sulfur dioxide. The limestone is calcined by the combustion temperatures, and the sulfur dioxide then reacts with the calcium oxide and oxygen to form calcium sulfate. Sulfur removal depends on contact between the sulfur dioxide molecules and the calcium oxide particles.

Applicant has discovered and developed an arrangement whereby a pressurized fluidized bed combustor (PCFB) for burning sulfur containing fuels is constructed to operate at supercritical steam pressures. The pressurized circulating fluidized bed combustion chamber operates at elevated pressures considerably above atmospheric. The PCFB boiler has some advantages that lend itself to avoid the complications of the conventional boiler. These include smaller cross section combustors for the same heat duty. The number of wall tubes required is less, so the required mass flow through the tubes could be easily maintained.

SUMMARY OF THE INVENTION

It is the primary object of the present invention to provide a new pressurized circulating fluidized bed boiler system to operate under supercritical steam conditions.

In accordance with a primary aspect of the present invention, a power plant having a pressurized circulating fluidized bed (PCFB) boiler is provided with a first circuit comprising pipes in the combustor walls for withstanding supercritical pressures for circulating cooling fluid through the walls between a first header at the bottom of the chamber and a second header at the top of the chamber, a superheater circuit downstream of the boiler, a water-steam separator for separating water from steam during start-up and directing the steam to the superheater circuit, and a by-pass line for bypassing the separator during normal operating conditions.

BRIEF DESCRIPTION OF THE PREFERRED EMBODIMENTS

The above and other objects and advantages of the present invention will become apparent from the following description when read in conjunction with the accompanying drawings wherein:

FIG. 1 is a diagrammatic illustration of a circulating fluidized bed combustion system in accordance with the present invention; and FIG. 2 is a schematic diagram illustrating a fluid circuit of a circulating fluidized bed combustion system in accordance with the present invention.

DETAILED DESCRIPTION OF THE PREFERRED EMBODIMENTS

Figure 1:
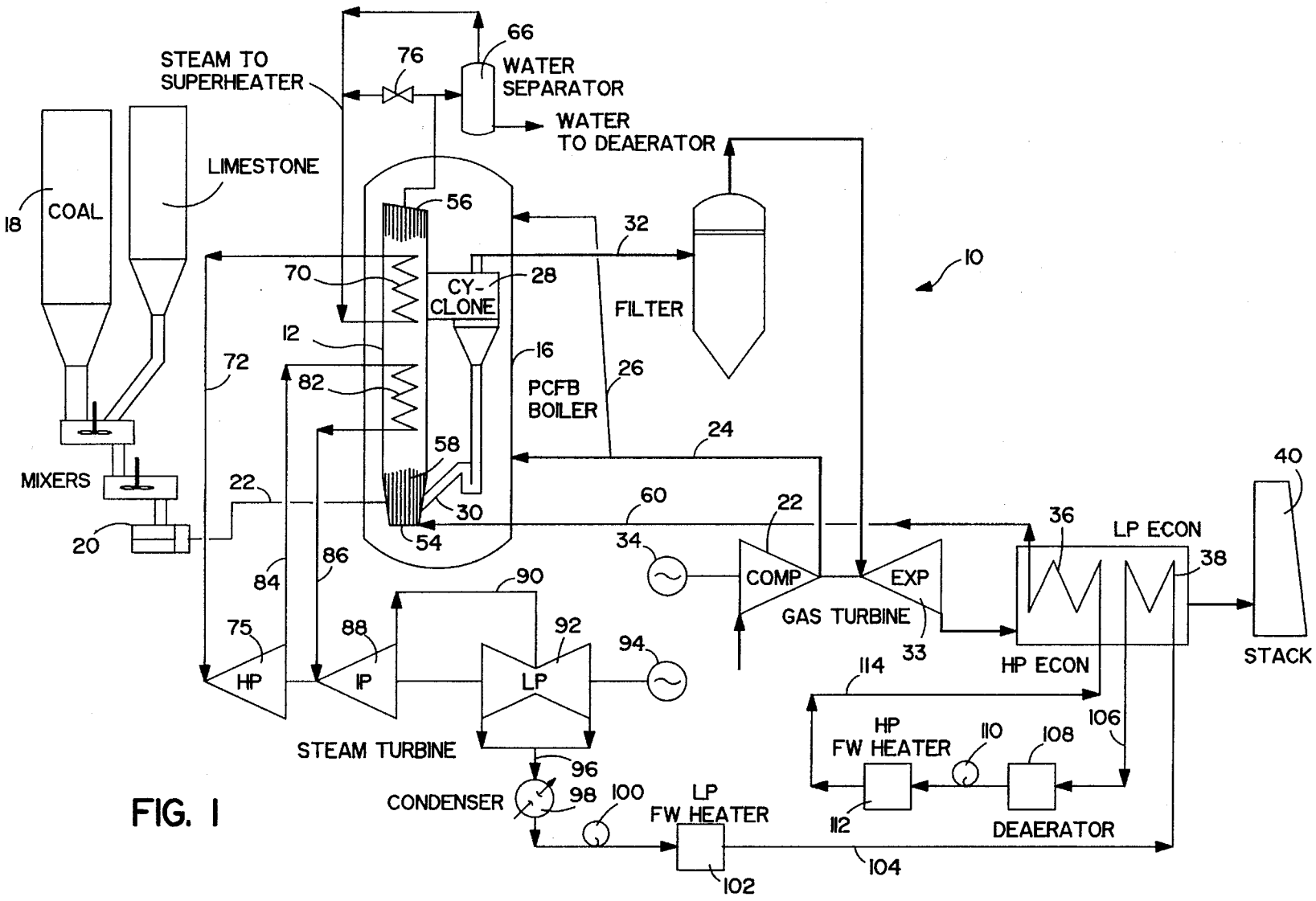

Referring to FIG. 1 of the drawings, there is schematically illustrated a pressurized circulating fluidized bed (PCFB) power plant, designated generally by the numeral 10, constructed generally in accordance with the present invention. In the illustrated embodiment, a boiler or furnace housing 12 forms a combustion chamber 14 generally of a vertical rectangular configuration, with inlets at the bottom thereof for feeding of fuel, limestone, recirculating particles and primary air for combustion and fluidization. The housing 12 is encompassed within a pressure vessel 16 which receives pressurized secondary air which flows around the boiler. This air cools the boiler and its components before entering the combustor through secondary air injection ports. Pressurized air is supplied by a compressor of a gas turbine. Combustion of fuel such as coal occurs in the combustor where most of the heat for the steam cycle is generated. This division of primary and secondary air reduces NOX emissions.

Fuel is fed from a suitable source, such as a hopper 18 and mixed with water and limestone or other absorbents and fed, such as a pump 20 by way of a conduit to the bottom of the combustor. A gas turbine compressor 22 supplies air for combustion via lines 24 and 26 to the PCFB combustor. Gas or air velocity in the combustor is about 15 feet per second (4.6 m/s) at pressure range of 150–250 psia (1035–1720 k Pa). Because of the continuous mixing throughout the combustor, and the thermal inertia of the solids in the hot loop, the gas temperature is substantially constant from the bottom to the top of the combustor.

The pressurized fluid bed system as illustrated is constructed for supercritical operation, that is, with steam pressures above 3208 psi and preferably in the range of thirty-five hundred to fifty-five hundred psi. The walls of the combustion chamber are thus lined with vertically disposed water pipes or tubes. These tubes are high pressure and have a diameter in the range of one to two inches to achieve the essential mass flow.

A hot cyclone 28 receives the fluidized circulating fuel and sorbents separating the solids from the hot gasses and returning the solids to the bottom of the combustion chamber by way of a loop seal at 30. The hot exhaust gasses are passed along a duct system 32 through ceramic filter where fine particles are separated from the hot flue gases. The hot flue gases are then fed to an expander 33 of a gas turbine which drives the compressor and a generator 34 for generating electrical power. The exhaust from the gas turbine is fed to a high pressure economizer 36, to a low pressure economizer 38 and then to a stack 40.

In accordance with the invention, the boiler is equipped with high pressure steam tubes inside the combustion chamber to permit operation in the supercritical range of from thirty-five hundred psi to fifty-five hundred psi at around one-thousand degrees Fahrenheit. The Applicant has discovered that due to the smaller size of the circulating bed combustion chambers the pressurized circulating fluidized bed boiler does not have some of the complications of the conventional boilers equipped for supercritical steam operations. Because the combustor cross section dimension of the PCFB is smaller than that of a conventional boiler for the same heat duty, it is easier to maintain proper velocity for cooling of the combustor wall tubes.

Figure 2:
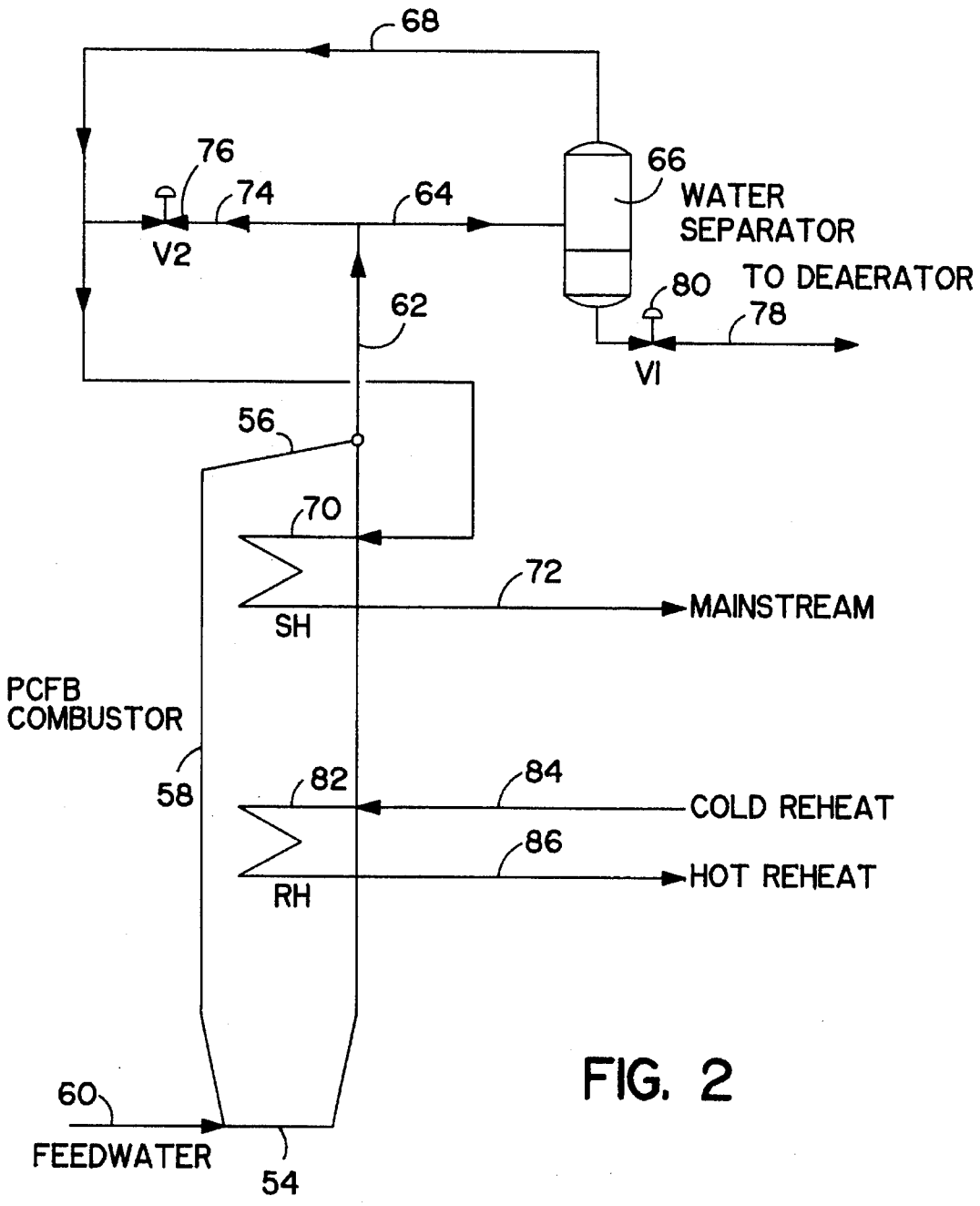

Referring to FIG. 2 of the drawings, a schematic illustration of the water steam circuit for the boiler of the present invention is illustrated. In accordance with a preferred embodiment of the invention, the walls of the combustor are formed or lined with high pressure tubes connected and extending from a header 54 at the bottom of the combustion chamber extending vertically to an upper header 56 at the top of the combustion chamber. This is a parallel circuit between header 54 and header 56. The walls are thus lined with high pressure tubes 58 designed for withstanding the supercritical steam pressures. Feedwater from the economizer 36 is fed via the feed pipe 60 into the header system 54 at the bottom of the combustion chamber and flows by way of the tubes to the header 56 wherein the steam flows by a line 62 to a line 64 and to a water separator 66. Steam from the separator is then transmitted via line 68 to a superheater 70 from which it then flows via the main steam 72 to the inlet of a high pressure stage 75 of a steam turbine. A line 74, including a valve V2, which bypasses the steam to the water separator and remains closed during initial start up or at very low loads. Once supercritical conditions are reached, the steam from the combustor headers can go directly to the superheater by way of valve 76.

The separated water from the water separator is discharged to a deaerator or to a drain tank by way of a line 78 and valve 80. The combustor includes a reheater 82 receiving cold reheat steam by way of line 84 and returning it by way of line 86 to an intermediate stage 88 of the steam turbine. The steam exhausted from the intermediate state may be fed via a line 90 to a low pressure state 92 of the turbine as illustrated in FIG. 1. The steam turbine drives a generator 94 for generating electrical power.

Steam exhausted from the steam turbine passes via line 96 through a condensor 98 and by pump 100 through a low pressure feed water heater 102 and via line 104 to the low pressure economizer 38. Water from the economizer 38 is fed via line 106 to deaerator 108 and is pumped via pump 110 through high pressure feed water heater 112 and by line 114 high pressure economizer 36.

The construction of the pressurized circulating fluidized bed boiler system to operate in the supercritical range has been discovered to be practical and to have a number of advantages over conventional systems. Among these advantages is the ability to more easily operate under varying load conditions and to maintain proper mass flow through the water wall tubes. Additional advantages are the much higher efficiency achieved not only for the fluidized bed boiler but over that of conventional systems. The lower combustion temperature aids in reducing the formation of NOX. The pressurized circulating fluidized bed furnace with its accompanying filters requires substantially less space than alternative conventional systems. The system is less complex in many aspects, particularly in fewer fuel feed points.

A simplified or less complex load following is accomplished by varying the fuel feed rate and the ratio of primary to secondary air to the combustor. The circulating fluidized bed combustor also has the capability of efficiently utilizing a much wider variety of fuels than other systems. The system is thus discovered to be ideally suited for supercritical steam conditions and thus achieve additional high efficiencies.

Many modifications and changes are possible in the foregoing disclosure and in some instances, some features may be employed without the corresponding use of other features. Accordingly, while the present invention has been illustrated and described with respect to specific embodiments, it is to be understood that numerous changes and modifications may be made therein without departing from the spirit and scope of the invention as defined in the appended claims.

I claim:

1. A pressurized circulating fluidized bed boiler having a water circulating system for normally operating at supercritical conditions, comprising:

a pressurized fluidized bed combustion chamber, said chamber defined by a plurality of upstanding peripheral side walls defining a combustion chamber having a vertical orientation and a substantially rectangular cross-section;

means for introducing fuel into said chamber;

means for introducing a particulate sorbent into said combustion chamber;

means for establishing and maintaining said fuel and said sorbent in a fluidized state;

means for recirculating at least a portion of said fuel and said sorbent;

a first heat exchanger circuit comprising a plurality of high pressure tubes for withstanding supercritical pressures, said circuit including a feedwater inlet header at a lower portion of said combustor, an outlet header at an upper portion of said combustion chamber, and a plurality of high pressure tubes lining each of said upstanding peripheral walls for circulating water through the walls between said inlet header at the bottom of said chamber and said outlet header;

a superheater circuit;

means for separating water from steam in said first circuit downstream of said outlet header and directing said steam to said superheater circuit; and means for bypassing said means for separating during normal operating conditions.

2. A boiler according to claim 1 wherein said high pressure tubes comprises one to two inch tubes in the walls of said combustion chamber.

3. A boiler according to claims 2 wherein said tubes are designed to withstand pressures at least up to 3208 psi.

4. A boiler according to claim 1 wherein said tubes are designed to withstand pressures at least up to 3208 psi.

5. A boiler according to claim 4 wherein said tubes extend vertically for parallel flow from said inlet header to said outlet header.

6. A boiler according to claim 1 wherein said tubes extend vertically for parallel flow from said inlet header to said outlet header.

7. A boiler according to claim 6 wherein said high pressure tubes comprises one to two inch tubes in the walls of said combustion chamber.

8. A supercritical pressurized circulating fluidized bed boiler having a water circulating system for operating at supercritical conditions, comprising:

a pressurized fluidized bed combustion chamber, said chamber defined by a plurality of upstanding peripheral side walls defining a combustion chamber having a vertical orientation and a substantially rectangular cross-section;

means for introducing fuel into said chamber;

means for introducing a particulate sorbent into said combustion chamber;

means for establishing and maintaining said fuel and said sorbent in a fluidized state;

means for recirculating at least a portion of said fuel and said sorbent;

a first heat exchanger circuit comprising a plurality of high pressure tubes for withstanding supercritical pressures extending vertically within and lining each of said upstanding peripheral walls of said combustion chamber, said circuit including a feedwater inlet header at the bottom of said combustion chamber, and outlet header at the top of said combustion chamber;

a superheater circuit downstream of said first circuit;

steam water separating means for separating water from steam in said first circuit downstream of said outlet header and directing said steam to said superheater circuit; and means for bypassing said steam water separating means during normal operating conditions.

9. A boiler according to claim 8 wherein said high pressure tubes are from one to two inches in diameter.

10. A boiler according to claim 9 wherein said tubes are designed to withstand pressures at least up to 3208 psi.

11. A boiler according to claim 10 wherein said tubes extend vertically for parallel flow from said inlet header to said outlet header.

12. A supercritical pressurized circulating fluidized bed boiler having a water circulating system for operating under supercritical conditions, comprising:

a pressurized fluidized bed combustion chamber, said chamber defined by a plurality of upstanding peripheral side walls defining a combustion chamber having a vertical orientation and a substantially rectangular cross-section;

means for introducing a solid fuel into said combustion chamber;

means for introducing a particulate sorbent into said combustion chamber;

means for introducing pressurized air into said chamber for establishing and maintaining said fuel and said sorbent in a fluidized state;

means including a cyclone separator for separating and recirculating at least a portion of said fuel and said sorbent;

a first heat exchanger circuit comprising a feedwater inlet header at the bottom of said boiler, an outlet header at the top of said combustion chamber, a plurality of high pressure tubes from one to two inches in diameter for withstanding supercritical pressures of about 500 psi lining each of said upstanding peripheral walls for circulating cooling water through the walls from said inlet header at the bottom of said chamber to said outlet header at the top of said chamber;

a superheater circuit downstream of said first circuit;

a steam water separating means for separating water from steam in said first circuit downstream of said outlet header and directing said steam to said superheater circuit; and means for bypassing said steam water separating means during normal operating conditions.

* * * * *